US010835914B2

(12) United States Patent
Torlei

(10) Patent No.: US 10,835,914 B2
(45) Date of Patent: Nov. 17, 2020

(54) TELESCOPIC LANCE, AND IN COMBINATION A TELESCOPIC LANCE AND A TRIGGER GUN

(71) Applicant: SwanTech AS, Kleppestø (NO)

(72) Inventor: Morten Torlei, Bønes (NO)

(73) Assignee: SwanTech AS, Kleppesto (NO)

( * ) Notice: Subject to any disclaimer, the term of this patent is extended or adjusted under 35 U.S.C. 154(b) by 127 days.

(21) Appl. No.: 16/149,827

(22) Filed: Oct. 2, 2018

(65) Prior Publication Data

US 2019/0099773 A1 Apr. 4, 2019

(30) Foreign Application Priority Data

Oct. 3, 2017 (NO) ..... 20171579

(51) Int. Cl.
*B05B 15/628* (2018.01)
*B05B 9/01* (2006.01)

(52) U.S. Cl.
CPC ..... *B05B 15/628* (2018.02); *B05B 9/01* (2013.01)

(58) Field of Classification Search
CPC ..... B05B 9/01; B05B 15/628; B05B 15/656; A62C 31/22
See application file for complete search history.

(56) References Cited

U.S. PATENT DOCUMENTS 9,744,548 B2 * 8/2017 Gopalarao ..... B05B 9/01

FOREIGN PATENT DOCUMENTS

| | | | |
|---|---|---|---|
| DE | 202004 019949 | 3/2005 | |
| DE | 102010007374 | 8/2011 | |
| GB | 924585 | 4/1963 | |
| WO | 2014135936 | 9/2014 | |
| WO | WO-2016165743 A1 * | 10/2016 | ..... F16L 27/1273 |

* cited by examiner

*Primary Examiner* — Arthur O. Hall
*Assistant Examiner* — Steven M Cernoch
(74) *Attorney, Agent, or Firm* — Abelman, Frayne & Schwab

(57) ABSTRACT

A telescopic lance, comprising a lance handle (5) with a fixed inner pipe (3), an extractable outer pipe (4) and at least one locking mechanism (10,20), wherein the extractable outer pipe (4) is located outside, and slidably longitudinally arranged with the fixed inner pipe (3), and said locking mechanism (10,20) is arranged to allow motion of the extractable outer pipe (4) with respect to the fixed inner pipe (3). A first locking mechanism (20) comprises a protrusion (21) for engagement with a locking slot (22), wherein twisting of the extractable outer pipe (4) brings the protrusion (21) into or out of engagement with the locking slot (22), and a second locking mechanism (10) comprises a spring loaded lock handle (13) with a through going aperture (15) for trapping and releasing the extractable outer pipe (4). The invention also relates to a combination of a telescopic lance and a trigger gun (8) for use with a high pressure washer.

9 Claims, 2 Drawing Sheets

TELESCOPIC LANCE, AND IN COMBINATION A TELESCOPIC LANCE AND A TRIGGER GUN

FIELD OF THE INVENTION

The present invention relates to a telescopic lance, and more particularly to a lance where the length of the lance can be adjusted. More specific the invention relates to a telescopic lance comprising a lance handle with a fixed inner pipe, an extractable outer pipe and at least one locking mechanism, wherein the extractable outer pipe is located outside, and slidably longitudinally arranged with the fixed inner pipe, and the locking mechanism is arranged to allow motion of the extractable outer pipe with respect to the fixed inner pipe. The invention also relates to, in combination, a telescopic lance and a trigger gun for use with a high pressure washer.

BACKGROUND OF THE INVENTION

The spraying of material under pressure through a lance or handle of some kind and onto the desired area is a well known process. Examples include sand blasting, paining, spraying pesticides, pressurized air, and rubberizing layers. One of the most common examples is water used in power sprayers. These are commonly found in both industry and residential use. Water enters the power sprayer from a hose; where it is pressurized. The user directs the water stream in the desired direction and intensity using a trigger on the lance. Another common example is an air compressor that sprays compressed air.

There are many situations where the user wants to change the length of the lance. For example, the user wants to wash higher up on a wall than they can reach normally. Rather than getting a ladder, it is often easier and safer to change the length of the lance. This can be done by adding more individual rigid elements onto the lance itself.

Another possibility is to add telescoping segments to the lance. Telescoping segments are a series of progressively smaller tubes that fit inside each other and can extend out in length as required. These are usually locked by twisting one of the tubes with respect to another. This will cause an expansion mechanism to engage and lock it in place. The twisting motion can be difficult if the user's wrists are weak or considerable force needs to be applied. Additionally, the locking mechanism itself can wear out the telescoping tubes and weaken the connection point by excess wear and pressure from the locking action.

DISCLOSURE OF THE STATE OF ART

GB 924585 A discloses a device for blowing a suspension of lime in oxygen on to a melt, comprises a smooth tube connected to a stationary lime supply vessel, and a concentric tube of larger diameter terminating in a nozzle and forming part of a vertically adjustable lance, and being telescopically movable with respect to the inner tube. The water-cooled nozzle tube is joined at its upper end to a cup bearing engaging a sphere, with sealing rings, in a globe joint. The spherical portion is extended upwards to provide a stuffing-box closed by a plug portion containing a scraper. The lower end of the smooth tube extends down through the stuffing-box, and the upper end connects to the lime supply vessel outlet through a globe joint and a T-bend.

WO 2009/091266 A2 discloses an adjustable mechanism for connecting two or more shafts, including at least a first shaft having an external surface with an outer diameter and a second shaft which is hollow at a first end, wherein a spring is anchored to the first end of the second shaft, the spring having an inner diameter of similar dimensions to the outer diameter of the first shaft, the spring configured such that when a force is applied to the spring its inner diameter is greater than the outer diameter of the first shaft so that the second shaft can move over the first shaft to a desired position relative to the first shaft, and when the force is no longer applied to the spring it is biased to return to its original inner diameter to bear against the external surface of the first shaft.

FR 2522743 A1 discloses a lock for sliding tubes, and which has inclined ring within internal annular groove of outer tube. The lock is incorporated in an internal annular groove of the outer tube which slides over an internal tube. A locking ring, located in the groove, has an internal diameter slightly larger than the outside diameter of the inner tube. When the axes of the locking ring and the inner tube are parallel, the two components are free to move relative to each other. The plunger causes the ring to tilt about the pin and lock the two components together. The locking ring is released by the catch.

Reference is also made to DE 202004019949 U1 disclosing a shoulder rest having a fixing device for fitting on the spray lance or pistol gun through a quick-fit detachable coupling. The shoulder rest is telescopically adjustable in length through an adjuster. A shoulder support is mounted rotatable and/or pivotally relative to the spray lance and a shock-absorbing element is provided as a shoulder pad on the shoulder support. The fixing device preferably has two connectable half shells joined by screws.

DE 102010007374 A1 discloses a telescopic closure having a locking channel, retention element, transverse guidance and guide channel, which are fixed with each other by multiple connecting elements. The connecting elements are provided with a telescopic element. An independent claim is also included for a method for locking devices such as locking channel, retention element, transverse guidance and guide channel.

WO 2014135936 A1 discloses an extensible dispensing lance for washing devices which comprises at least a first tubular section, a first end of which is connectable to a gripping and support body of a supply conduit of a pressurized washing fluid, and an open second end able to dispense the washing fluid, characterised in that it comprises a tubular second section telescopically associated to the first section by interposing seal means and removable blocking means able to reciprocally block the first section and the second section.

OBJECTS OF THE PRESENT INVENTION

It is an object of the invention to provide an improved, or at least an alternative, telescopic lance for spraying of material under pressure.

Optionally the telescopic lance can be used with a high pressure washer, and in such a case an object is to provide a more safe and user friendly telescopic lance. It will be safer in that the user must use two hands and therefore can not push the trigger gun at the same time, thus avoiding pressurizing the lance during adjustment, or adjustment of the lance while it is under pressure. After the telescopic lance has been unlocked, the user can adjust the length of the telescopic lance.

The present invention allows the user to lock the parts of the telescopic lance in any desired length.

SUMMARY OF THE INVENTION

In a first aspect, the invention relates to a telescopic lance, comprising a lance handle with a fixed inner pipe, an extractable outer pipe and at least one locking mechanism, wherein the extractable outer pipe is located outside, and slidably longitudinally arranged with the fixed inner pipe, and said locking mechanism is arranged to allow motion of the extractable outer pipe with respect to the fixed inner pipe. A first locking mechanism comprises a protrusion for engagement with a locking slot, wherein twisting of the extractable outer pipe brings the protrusion into or out of engagement with the locking slot, and a second locking mechanism comprises a spring loaded lock handle with a through going aperture for trapping and releasing the extractable outer pipe.

Said protrusion can protrude from an outside of the extractable outer pipe and the locking slot can be provided on an inside of the lance handle. Alternatively can said protrusion protrude from an inside of the lance handle and the locking slot can be provided on an outside of the extractable outer pipe.

The first locking mechanism can comprise two protrusions placed diagonally opposite each other, and two locking slots placed diagonally opposite each other.

In one embodiment can the protrusion be triangular shaped, and the locking slot can be a longitudinally running saw tooth shaped slot.

The twisting motion is applied on a part of the extractable outer pipe extending out of the lance handle, in where said part of the extractable outer pipe extending out of the lance handle can comprise a grip handle.

The extractable outer pipe can on the outside have a longitudinally groove for receipt of a spring loaded pin, said pin being connected to a spring for counter rotation of the extractable outer pipe.

The pin can be arranged to move in a semi-circular and open groove on the inside of the lance handle, and the pin can be connected to the spring resting in a semi-circular bed in the lance handle.

The lance handle can comprise a second locking mechanism, in where said second locking mechanism comprises a spring loaded lock handle with a through going aperture for trapping and releasing the extractable outer pipe.

The extractable outer pipe can on the outside comprise several ring shaped cams and grooves in succession, in where an edge of the through going aperture is trapped in a groove between two cams when the spring loaded lock handle is not activated. The extractable outer pipe can be allowed to pass the through going aperture when the spring loaded lock handle is pushed down.

The protrusion(s) can be located at a distal part from the grip handle.

In a second aspect, the invention relates to, in combination, a telescopic lance and a trigger gun for use with a high pressure washer, said telescopic lance comprises a lance handle with a fixed inner pipe and an extractable outer pipe, wherein the extractable outer pipe is located outside, and slidably longitudinally arranged with the fixed inner pipe, and wherein a inlet connect of the lance handle is connected to the trigger gun. The lance handle comprises several locking mechanisms, wherein a first locking mechanism in a first part of the lance handle is arranged to allow motion of the extractable outer pipe with respect to the fixed inner pipe by twisting of the extractable outer pipe to bring a protrusion into or out of engagement with a locking slot, and wherein a second locking mechanism in a second part of the lance handle is arranged to allow motion of the extractable outer pipe with respect to the fixed inner pipe, said second locking mechanism comprises a spring loaded lock handle with a through going aperture for trapping and releasing the extractable outer pipe.

DESCRIPTION OF THE DIAGRAMS

Embodiments of the present invention will now be described, by way of example only, with reference to the following diagrams wherein.

Figure 3A:
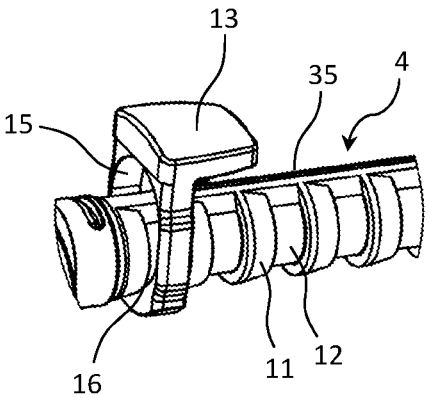
Figure 3B:
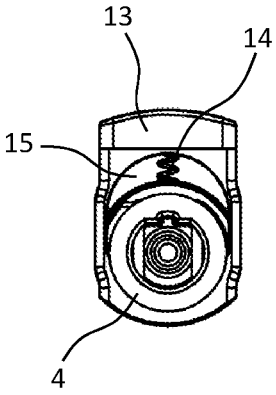
Figure 3C:
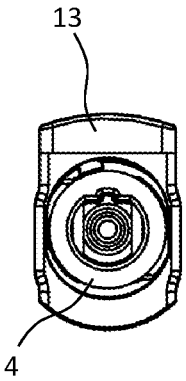

FIG. 3*a*-3*c* shows a second locking mechanism of the telescopic lance.

Figure 4A:
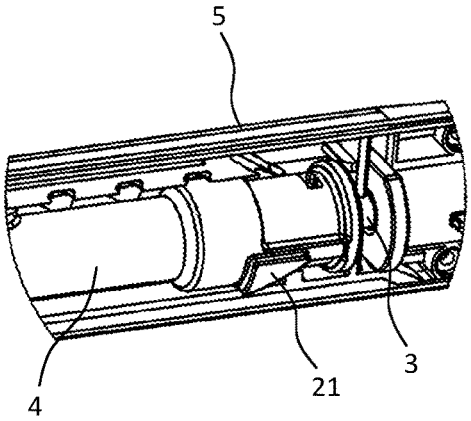
Figure 4B:
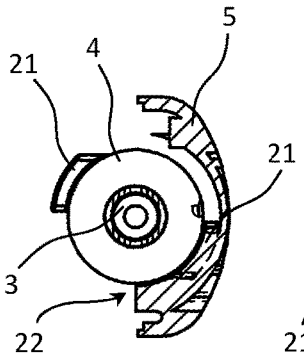
Figure 4C:
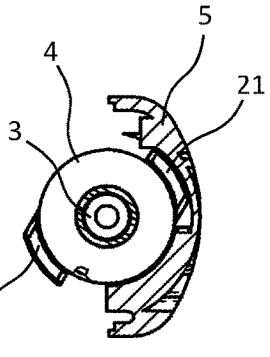

FIG. 4*a*-4*c* shows a first locking mechanism of the telescopic lance.

Figure 5:
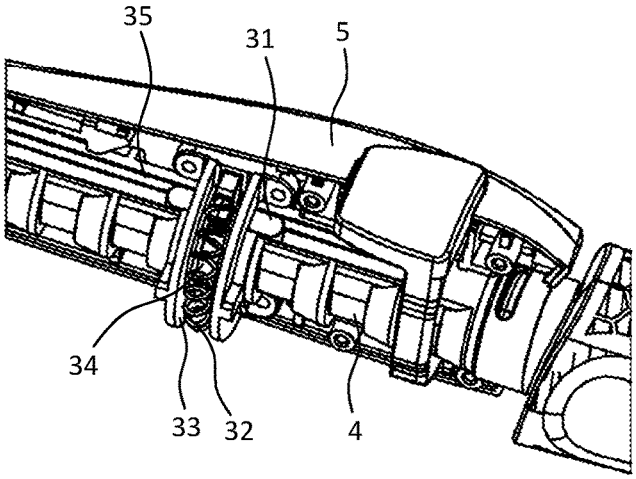

FIG. 5 shows a spring loaded pin for providing counter rotation of an extractable outer pipe.

Figure 6:
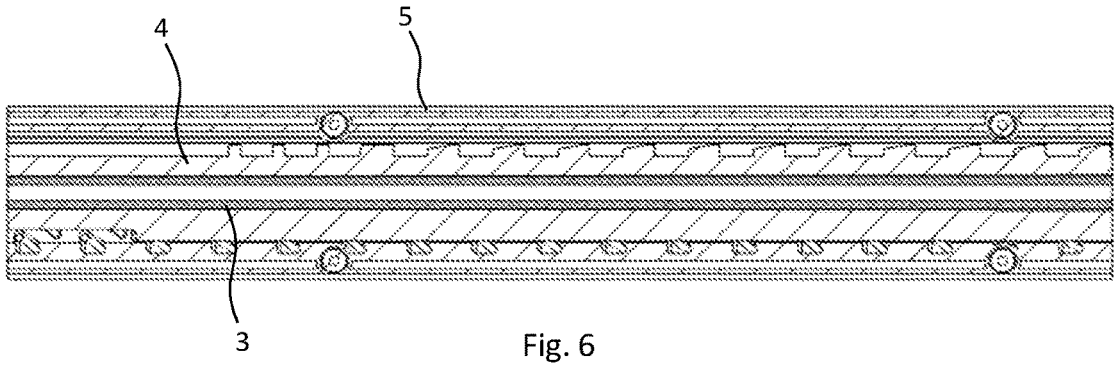

FIG. 6 shows in cross section a lance handle, an outer pipe and an inner pipe of the telescopic lance.

DESCRIPTION OF PREFERRED EMBODIMENTS OF THE INVENTION

Using the attached drawings, the technical contents, and detailed descriptions, the present invention is described. Alternate embodiments will also be presented. This is described in further detail below.

The present invention allows a user to adjust the length of a lance. The length adjustment is due to a telescopic arrangement of an extractable outer pipe and a fixed inner pipe.

This is described in further detail below. Note that the direction toward where the material enters the system (i.e. direction that the material is supplied from) will be referred to as the inlet side and where the material exits the lance will be referred to as the outlet side.

The present invention could be used to deliver a wide range of materials from the outlet such as sand, paint, chemicals, epoxy, rubber, etc. The invention is preferably directed toward water, steam, or air as the primary materials to be delivered.

The present invention can be used in both low pressure and high pressure systems. A typical low pressure system would be a traditional garden hose. A higher pressure system would be a pressure washer for home or commercial use. Another example of a higher pressure system would be for sand blasting.

Material enters the lance from the inlet connect 6, into the inner pipe 3, travels through the extractable outer pipe 4 and exits the lance through the outlet connect 7. The extractable outer pipe 4 slides over the inner pipe 3. It is in this way that the length of the telescopic lance can be adjusted. The extractable outer pipe 4 can for instance be a plastic pipe and the inner pipe can for instance be an aluminum pipe sealed by gaskets, such as O-rings.

A hollow lance handle 5 encloses the inner pipe 3 and the extractable outer pipe 4. Note that the inner pipe 3 does not protrude from the outlet side of the lance handle 5.

The inner pipe 3 is preferably fixed such that moving the extractable outer pipe 4 does not move the inner pipe 3. This can be accomplished by affixing the inner pipe 3 to the inlet connect 6 or other fixed point of the system. It is also preferable that the inlet side of the lance handle 5 is either affixed to the same fixed point as the inner pipe 3 (the inlet connect 6). It is also possible to affix the inlet side of the lance 33 handle to the inner pipe 3 itself.

Figure 1:
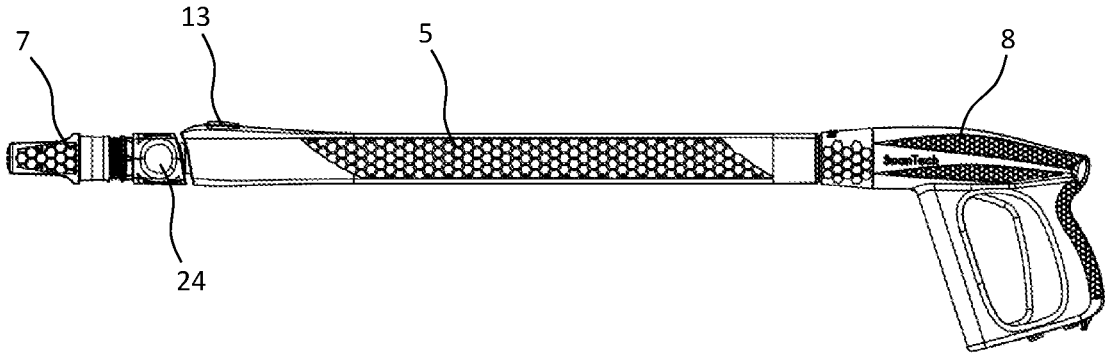
FIG. 1 shows in combination a telescopic lance and a trigger gun.

The telescopic lance according to the invention can comprise a first locking mechanism 20 and a second locking mechanism 10. When the telescopic lance is used in a high pressure washer together with a trigger gun 8, as seen in FIG. 1, it is preferable to use both the first locking mechanism 20 and the second locking mechanism 10. In other applications, it is possible to use only the first locking mechanism 20.

Figure 2:
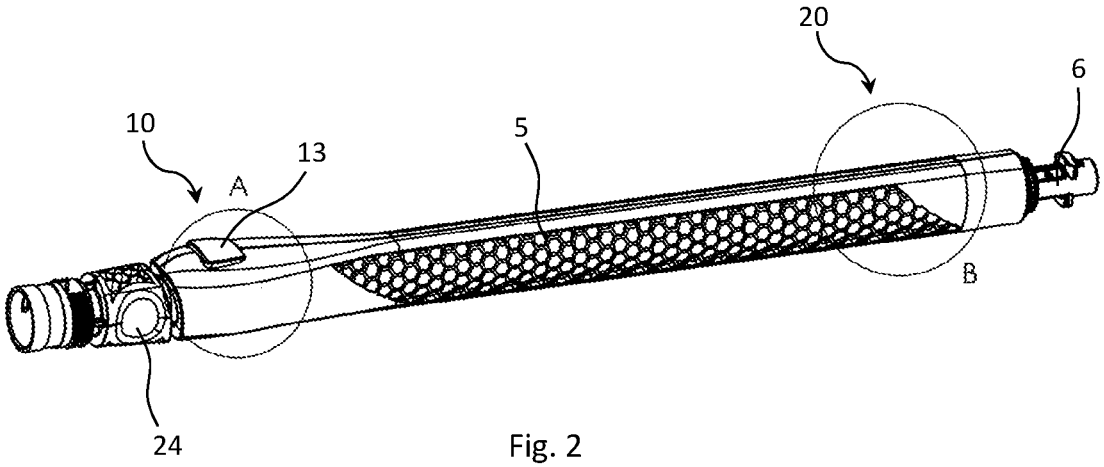
FIG. 2 shows the telescopic lance.

The first locking mechanism 20 is seen in detail in FIGS. 4*a*-4*c*, which shows detail B in FIG. 2. The first locking mechanism 20 comprises a protrusion 21 for engagement with a locking slot 22. Twisting of the extractable outer pipe 4 will bring the protrusion 21 into or out of engagement with the locking slot 22. In the preferred embodiment shown in the drawings, the protrusion 21 protrudes from an outside of the extractable outer pipe 4 and the locking slot 22 is provided on an inside of the lance handle 5. However, it is possible that the said protrusion 21 protrudes from an inside of the lance handle 5 and the locking slot 22 is provided on an outside of the extractable outer pipe 4.

As shown in FIG. 4*a*, an embodiment of the protrusion 21 is triangular shaped and is placed at a distal end part of the extractable outer pipe 4. The locking slot 21 can be a longitudinally running saw tooth shaped slot or groove, running for instance on a major part on the inside of the lance handle 5. Two protrusions 21 can be placed diagonally opposite each other, and two locking slots 22 can be placed diagonally opposite each other.

The first locking mechanism 20 is operated by applying a twisting motion to a part of the extractable outer pipe 4 extending out of the lance handle 5. For instance as seen in FIG. 2 where said part of the extractable outer pipe 4 extending out of the lance handle 5 comprises a grip handle 24. When the extractable outer pipe 4 is twisted, for instance by turning the extractable outer pipe 4 clockwise, the protrusion(s) 21 will move from the locked position shown in FIG. 4*b* to the unlocked position shown in FIG. 4*c*, and the outer pipe 4 can be extracted from the lance handle 5.

To ensure that the extractable outer pipe 4 easily can be retracted in to the lance handle and to provide counter rotation of the extractable outer pipe 4 can a spring loaded pin 31 be used. The extractable outer pipe 4 has on the outside a longitudinally groove 30 for receipt of the spring loaded pin 31. The longitudinally groove 30 can run next to a ridge 35 on top of the extractable outer pipe 4. The pin is connected to a spring 32 for counter rotation of the extractable outer pipe 4 in that the pin 31 is arranged to move in a semi-circular and open groove 34 on the inside of the lance handle 5. The pin 31 is connected to the spring 32 resting in a semi-circular bed 33 in the lance handle 5. The pin 31, spring 32 and bed 33 can be protected by a cover screwed onto the lance handle 5.

As mentioned, the telescopic lance according to the invention can comprise a first locking mechanism 20 and a second locking mechanism 10. The second locking mechanism 10 is similar placed in the lance handle 5. As seen in FIG. 3*a*-3*c* the second locking mechanism 10 comprises a spring loaded lock handle 13 with a through going aperture 15 for trapping and releasing the extractable outer pipe (4).

In that respect the extractable outer pipe 4 comprises on the outside several ring shaped cams 11 and grooves 12 provided in succession along the outer pipe 4. When the spring loaded lock handle 13 is not activated, as shown in FIG. 3*b*, a spring 14 forces the lock handle 13 upwards and an edge 16 of the through going aperture 15 is thus trapped in a groove 12 between two cams 11. When the spring loaded lock handle 13 is pushed down, as seen in FIG. 3*c*, the extractable outer pipe 4 is allowed to pass the through going aperture 15. By releasing the spring loaded lock handle 13 the extractable outer pipe 4 can be trapped or locked in any desired position.

The lance handle 5 can comprise two half moon shaped parts that are screwed together.

The invention claimed is:

1. A telescopic lance comprising:

a lance handle with a fixed inner pipe, an extractable outer pipe, a first locking member and a second locking mechanism, the extractable outer pipe being located outside and longitudinally slidable with respect to the fixed inner pipe;

said first and second locking mechanisms allowing movement of the extractable outer pipe with respect to the fixed inner pipe, wherein the first locking mechanism comprises a protrusion engaging a locking slot, wherein twisting of the extractable outer pipe brings the protrusion into or out of engagement with the locking slot, and the second locking mechanism comprises a spring loaded lock handle with a through going aperture for trapping and releasing the extractable outer pipe; and wherein the extractable outer pine on the outside comprises several ring shaped cams and grooves in succession, in where an edge of the through going aperture is trapped in a groove between two cams when the spring loaded lock handle is not activated, and the extractable outer pipe is allowed to pass the through going aperture when the spring loaded lock handle is pushed down.

2. The telescopic lance according to claim 1, wherein said protrusion protrudes from an outside of the extractable outer pipe and the locking slot is provided on an inside of the lance handle, or said protrusion protrudes from an inside of the lance handle and the locking slot is provided on an outside of the extractable outer pipe.

3. The telescopic lance according to claim 1, wherein the first locking mechanism comprises two protrusions placed diagonally opposite each other, and two locking slots placed diagonally opposite each other.

4. The telescopic lance according to claim 1, wherein the protrusion is triangular shaped, and the locking slot is a longitudinally running saw tooth shaped slot.

5. The telescopic lance according to claim 1, wherein the twisting motion is applied on a part of the extractable outer pipe extending out of the lance handle, in where said part of the extractable outer pipe extending out of the lance handle comprises a grip handle.

6. The telescopic lance according, to claim 1, wherein in the extractable outer pipe on the outside has a longitudinally groove for receipt of a spring loaded pin, said pin being connected to a spring for counter rotation of the extractable outer pipe.

7. The telescopic lance according to claim 6, wherein the pin is arranged to move in a semi-circular and open groove on the inside of the lance handle, and the pin is connected to the spring resting in a semi-circular bed in the lance handle.

8. The telescopic lance according to claim 1, wherein the protrusion is located a distal part from the grip handle.

9. An apparatus comprising:

a telescopic lance and a trigger gun for use with a high pressure washer, said telescopic, lance comprising:

a lance handle with a fixed inner pipe and an extractable outer pipe, the extractable outer pipe being located outside, and longitudinally slidably with respect to the fixed inner pipe, and an inlet connection of the lance handle is connected to the trigger gun;

wherein the lance handle comprises a first and a second locking mechanism, wherein the first locking mechanism in a first part of the lance handle allows movement of the extractable outer pipe with respect to the fixed inner pipe by twisting of the extractable outer pipe to bring a protrusion into or out of engagement with a locking slot, and the second locking mechanism in a second part of the lance handle allows movement of the extractable outer pipe with respect to the fixed inner pipe;

wherein said second locking mechanism comprises a spring loaded lock handle with a through going aperture for trapping and releasing the extractable outer pipe, wherein the extractable outer pipe on the outside comprises several ring shaped cams and grooves in succession, in where an edge of the through going aperture is trapped in a groove between two cams when the spring loaded lock handle is not activated, and the extractable outer pipe is allowed to pass the through going aperture when the spring loaded lock handle is pushed down.

* * * * *